US006764992B2

(12) United States Patent
Kumar et al.

(10) Patent No.: US 6,764,992 B2
(45) Date of Patent: Jul. 20, 2004

(54) SOIL RELEASE POLYMERS AND LAUNDRY DETERGENT COMPOSITIONS CONTAINING THEM

(75) Inventors: Velayudhan Nair Gopa Kumar, Maharashtra (IN); Anuradha Moulee, Maharashtra (IN)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 376 days.

(21) Appl. No.: 09/852,095

(22) Filed: May 9, 2001

(65) Prior Publication Data

US 2002/0016282 A1 Feb. 7, 2002

(30) Foreign Application Priority Data

May 9, 2000 (IN) ..... 423/MUM/00
Jul. 25, 2000 (GB) ..... 0018287

(51) Int. Cl.[7] ..... C11D 1/02; C11D 3/22; C11D 3/37

(52) U.S. Cl. ..... 510/470; 524/47; 524/52; 524/58; 524/68; 525/54.2; 525/54.24; 510/299; 510/361; 510/434; 510/471; 510/472; 510/474; 510/476; 510/477; 510/528

(58) Field of Search ..... 524/47, 52, 58, 524/68; 525/54.2, 54.24; 510/299, 361, 434, 470, 471, 472, 474, 476, 477, 528

(56) References Cited

U.S. PATENT DOCUMENTS 3,558,499 A 1/1971 Galvin et al. ..... 252/137
3,948,838 A 4/1976 Hinton, Jr. et al. ..... 260/29.4
3,959,230 A 5/1976 Hays ..... 260/75
4,116,885 A 9/1978 Derstadt et al. ..... 252/532
4,925,588 A 5/1990 Berrod et al. ..... 252/174.23
5,223,171 A * 6/1993 Jost et al. ..... 252/174.17
5,227,446 A * 7/1993 Denzinger et al. ..... 527/314
5,854,321 A * 12/1998 Krause et al. ..... 524/58
2002/0016282 A1 * 2/2002 Kumar et al. ..... 510/474

FOREIGN PATENT DOCUMENTS

| | | | |
|---|---|---|---|
| DE | 2 742 595 | 4/1979 | ..... C08F/251/00 |
| DE | 43 16 746 | 11/1994 | ..... C11D/3/37 |
| DE | 4316746 | * 11/1994 | ..... C11D/3/37 |
| GB | 2 322 137 | 8/1998 | ..... C11D/3/37 |
| JP | 10/266095 | 10/1998 | ..... D21H/19/10 |
| WO | WO 01/88075 | * 11/2001 | ..... C11D/3/22 |

OTHER PUBLICATIONS

PCT International Search Report in a PCT application PCT/EP 01/04942 Oct. 24, 2001.

GB Search Report in a GB application GB 0018287.3. Nov. 28, 2000.

* cited by examiner

*Primary Examiner*—Brian P. Mruk
(74) *Attorney, Agent, or Firm*—Rimma Mitelman

(57) ABSTRACT

Anionic, hydrophobic polysaccharides useful as soil release agents in detergent compositions are graft copolymers of a polysaccharide having anionic substituents with an ethylenically unsaturated monomer, the copolymer having a polysaccharide backbone carrying grafted hydrophobic vinyl polymeric groups derived from the ethylenically unsaturated monomer, and anionic substituents. The polymers exhibit enhanced release of both oily and particulate soil from both polyester and cotton.

19 Claims, No Drawings

SOIL RELEASE POLYMERS AND LAUNDRY DETERGENT COMPOSITIONS CONTAINING THEM

TECHNICAL FIELD

The present invention relates to novel soil release polymers for detergent formulations capable of enhancing soil removal from cotton or polyester fabric or their blends and a process for the preparation of the same.

BACKGROUND OF THE INVENTION

The washing of soiled fabrics with a laundry detergent is essentially a two step process. In the first stage, the detergent must remove the soil particles from the fabric and suspend them in the soil solution. In the second stage the detergent must prevent soil particles and other insolubles from re-depositing on the cloth before and after the fabric is removed from the soil solution or the rinse solution. Polymers are known to aid both processes—soil release polymers enhance soil removal from the fabric whilst anti-redeposition polymers prevent the deterged soil from depositing on the fabric.

The thrust in recent times has been the development of soil release polymers (SRPs), which can be incorporated into detergent formulations, to enhance the removal of soil from the fabric. SRPs adsorb on the fabric surface, modifying properties like the hydrophilic or hydrophobic nature of the fabric and its surface energy. Consequent soil removal is greater than what is possible with a conventional detergent formulation.

Soil release polymers disclosed in the literature address the problem of removal of oily or fatty soils from polyester. Polyester is a hydrophobic fabric and removal of hydrophobic, oily soils from the fabric has historically been a problem. The problem has been circumvented in part by using soil release polymers which combine hydrophobic and hydrophilic segments. The polymers adsorb strongly on the fabric, are easily dispersed or dissolved in a surfactant and are compatible with the components of the detergent formulation. When incorporated in a detergent formulation, they aid oily soil removal.

Various soil release polymers have been disclosed in the prior art for removal of oily soils from polyester. A vast majority are polyesters that have been hydrophilically modified. U.S. Pat. No. 3,959,230 and U.S. Pat. No. 4,116,885 disclose modified polyesters as soil release agents for detergent formulations.

GB2322137 discloses the hydrophobic modification of starch (starch is the hydrophilic segment) and its use as a soil release polymer, in particular for detergency of oily soil from polyester fabric. Hydrophobic modification was carried out by graft copolymerising starch with hydrophobic monomers.

U.S. Pat. No. 5,227,446 discloses a polysaccharide modified with a) a monoethylenically unsaturated dicarboxylic acid/anhydride/alkali metal salt, b) monoethylenically unsaturated carboxylic acid/alkali metal salt and c) monomer containing two or more ethylenically unsaturated, non-conjugated double bonds in the molecule.

SRPs for removal of oily soil from cotton have also been disclosed. U.S. Pat. No. 3,948,838 discloses the use of copolymers of hydrophobic acrylic monomers and water soluble monomers like acrylic acid, as oily soil release agents for cotton fabrics.

Hence, polymers are known in the prior art for removal of oily soil from cotton or polyester. However, polymers that can aid removal of oily and particulate soil or their mixtures from cotton and polyester have not been disclosed.

SUMMARY OF THE INVENTION

Thus according to the present invention, novel soil release polymers that are anionic, hydrophobic graft copolymers of polysaccharides are provided. The soil release polymers can be incorporated in detergent formulations and aid the removal of oily and particulate soil from cotton, polyester or their blends. The polymers can also be used in rinse conditioners. A process for making these soil release polymers comprising the steps of anionic modification and graft copolymerisation is also provided.

DEFINITION OF THE INVENTION

According to a first aspect of the present invention, there is provided an anionic, hydrophobic polysaccharide which is a graft copolymer of a polysaccharide having anionic substituents with an ethylenically unsaturated monomer, the copolymer having a polysaccharide backbone carrying grafted hydrophobic vinyl polymeric groups derived from the ethylenically unsaturated monomer, and anionic substituents, preferably a group which possesses a carboxylic or a sulphonic acid head group or a salt thereof.

More specifically the invention provides an anionic, hydrophobic polysaccharide having the general formula I:

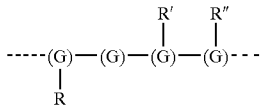

(I)

wherein R is a hydrophobic vinyl polymer, R' and R" which may or may not be the same represents a group which possesses a carboxylic or a sulphonic acid head group or a salt thereof and G is a monosaccharide or substituted monosaccharide.

According to a second aspect of the present invention there is provided a process for the preparation of an anionic, hydrophobic polysaccharide as previously defined, comprising the steps of graft copolymerisation and anionic modification of a polysaccharide.

According to a third aspect of the present invention there is provided a fabric treatment composition comprising a fabric treatment agent and from 0.01 to 10 wt % of a anionic, hydrophobic polysaccharide as previously defined.

According to a fourth aspect of the present invention there is provided a detergent composition comprising from 5 to 60 wt % of a detersive surfactant and from 0.01 to 10 wt % of an anionic, hydrophobic polysaccharide as previously defined.

DETAILED DESCRIPTION OF THE INVENTION

The Anionic, Hydrophobic Polysaccharide

The anionic, hydrophobic graft copolymer of polysaccharide of the current invention has the general structure given below:

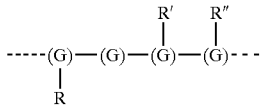

(I)

wherein R is a hydrophobic vinyl polymer, R' and R" which may or may not be the same, represent a group which possesses a carboxylic or a sulphonic acid head group or a salt thereof and G is a monosaccharide or substituted monosaccharide.

It is preferable that G is a monosaccharide.

In a first preferred embodiment, R' and R" are polymeric vinyl sulphonate groups such as $—(CH_2—CHSO_3H)_n$ and $—(CH_2—CHSO_3^-M^+)_n$, wherein M is an alkali or alkaline earth metal and n has a value of from 5 to 100. In a second preferred embodiment, R' and R" are alkylene carboxylates of the general form $—R_3—COOH$ and $—R_3—COO^-M^+$, wherein $R_3$ is a $C_1$ to $C_4$ alkylene group, $C_1$ being especially preferred, and M is an alkali or alkaline earth metal.

The hydrophobic vinyl polymer can be attached to the polysaccharide backbone through the hydroxyl group or through any of the carbon atoms on the sugar. The polymer chains can be present at irregular intervals on the polysaccharide chain and it is not critical that they be present at regular intervals. Up to 50% homopolymer may be present without impairing soil release performance. The anionic group is attached to the polysaccharide backbone through the hydroxyl group, either primary or secondary. It is not essential that anionic substituents be present on each of the sugar rings.

It is not essential to remove any unreacted polysaccharide that may be present in the final product obtained by graft copolymerisation and anionic modification of the polysaccharide.

The polysaccharide, which is the hydrophilic part of the molecule, is preferably chosen from cellulose, guar gum, starch and tamarind kernel powder but is not limited by the same. More preferably the polysaccharide is starch. The starch can be any native starch and includes those derived from wheat, rice, oat, tapioca, maize, potato, sorghum, arrowroot or their mixtures thereof. Alternatively, acid or enzymatically degraded starch or oxidised starch or their mixtures or their mixtures thereof with the native starches can also be used.

When starch is the preferred polysaccharide, it may be in the native form or gelatinised form. The term gelatinisation refers to rupture of the starch granule at elevated temperatures in presence of water.

The hydrophobic modification is provided by a hydrophobic vinyl polymer (R in Formula I) grafted onto the polysaccharide backbone. The polymers of vinyl monomers like acrylic monomers, vinyl acetate, styrene and substituted styrenes are especially preferred. The molecular weight of each of the hydrophobic vinyl polymer chains is preferably 500–5,000,000, more preferably from 2000–500,000 and most preferably from 5000–100,000.

The amount of the hydrophobic vinyl polymer is preferably 0.1–10% by weight of the polysaccharide, more preferably from 1–5% by weight of the polysaccharide.

Preferably, acrylic monomers are used for graft copolymerisation. The hydrophobic acrylic polymers especially suitable for the present invention are shown below having the general formula II:

(II)

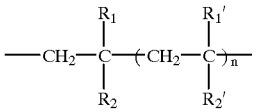

wherein $R_1$ and $R_1'$ may or may not be the same and represent —H, $—CH_3$, $—C_2H_5$.

and wherein $R_2$ and $R_2'$ may or may not be the same and represent $—COOCH_3$, $—COOC_2H_5$, $—COOC_3H_7$.

Particularly preferred is poly (methyl acrylate) wherein $R_1=R_1'=H$ and $R_2=R_2'=—COOCH_3$.

The anionic group, which may be a group which possesses a carboxylic or a sulphonic acid head group or a salt thereof, is distributed along the backbone of the polysaccharide. The compounds of the invention may contain both groups with carboxylic acid or sulphonic acid head groups (or their salts) as anionic substituents.

The amount of the anionic substituent is preferably 0.1–10% by weight of the polysaccharide, more preferably from 0.1–5% by weight of the polysaccharide.

Preferred examples of anionic reagents for effecting anionic modification of the polysaccharide are halocarboxylic acids or their salts and vinyl sulphonic acid or their salts or their mixtures thereof. More preferably the halocarboxylic acids are used as anionic reagents. Chloroacetic acid is especially preferred.

Examples of Preferred Modified Polysaccharides

The following formulae are representative examples of anionic, hydrophobic polysaccharides of the invention (formula I).

In the figures,

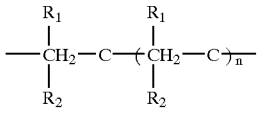

R represents $R_1=H$ and $R_2=—COOCH_3$ and $R'=—CH_2COOH$.

FORMULA III

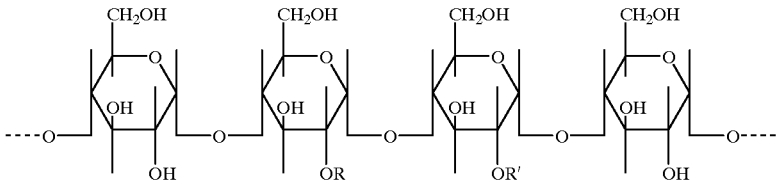

FORMULA IV

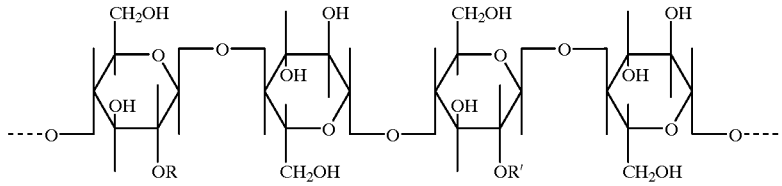

FORMULA V

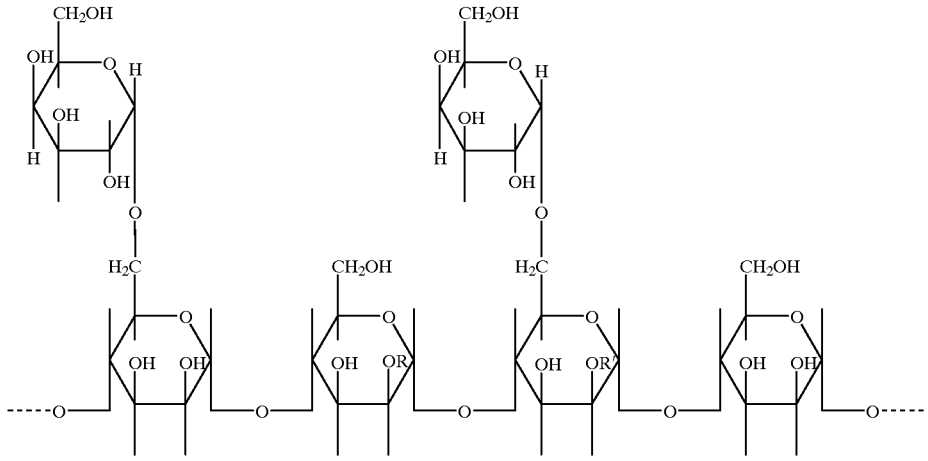

FORMULA VI

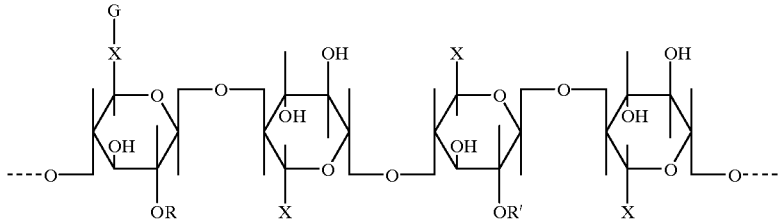

Where X =

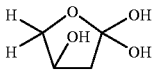

XYLOSE

G =

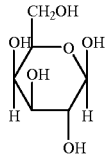

GALACTOSE

Preparation of the Anionic, Hydrophobic Polysaccharides

The soil release polymers of the invention are prepared by a) graft copolymerisation and b) anionic modification of the polysaccharide. It is not particularly relevant for the present invention as to which step is carried out first. Preferably, the step of graft copolymerisation of the polysaccharide is carried out first, followed by anionic modification.

Both graft copolymerisation and anionic modification of the polysaccharide can take place through the primary and/or the secondary hydroxyl groups on the polysaccharide backbone. Graft copolymerisation can also be initiated by H abstraction from the monosaccharide residue.

Graft copolymerisation is carried out by contacting the redox initiator, such as ferrous ammonium sulphate and hydrogen peroxide or ceric ammonium nitrate and dilute nitric acid, with the polysaccharide in an aqueous medium. A preferred temperature range is 20–60° C., more preferably from 30–40° C. It is preferable to add an entrainer, an example of which is urea. When the ferrous ammonium sulphate and hydrogen peroxide system is used as the redox initiatior, it is preferable to also add ascorbic acid. The hydrophobic monomer is added and subsequent polymerisation takes place to yield the polymer of the invention.

The hydrophobic graft copolymer so prepared is preferably reacted with a carboxylating or sulphonating reagent selected from halocarboxylic acid, an alkali or alkaline earth metal salt of a halocarboxylic acid, vinyl sulphonic acid or the alkali or alkaline earth metal salt of the vinyl sulphonic acid. It is preferable to use haloacetic acid, more preferably chloroacetic acid, to provide anionic groups on the polysaccharide. The process of anionic modification may be carried out in presence of a solvent such as water/isopropanol mixtures or as a dry process.

When the soil release polymer of the invention is prepared from native starch, it is preferred to subject the same to a temperature of 70–90° C. in presence of water, to make the soil release polymer water soluble.

Fabric Treatment and Detergent Compositions

The soil release polymer of the invention may be used to treat fabric by incorporating it into detergent compositions, rinse conditioners or other fabric treatment compositions. It can also be used simply as an aqueous solution which can be applied to the fabric to enhance soil removal from the fabric.

The polymers of the invention are suitably incorporated at the level of 0.01–10 wt %, preferably 0.5–5 wt %, of the detergent or fabric treatment composition.

The soil release polymers may advantageously be incorporated into built laundry detergent compositions suitable for heavy duty use. A preferred detergent composition in accordance with the invention may contain from 5 to 40 wt % of detersive surfactant (detergent-active material), from 5 to 80 wt % of detergency builder, and from 0.01 to 10 wt %, preferably from 0.5 to 5 wt %, of the soil release polymer of the invention.

Apart from the polymers of the invention, the detergent formulations also contain as in conventional formulations, detergent actives (surfactants) and builders and auxiliaries. Auxiliaries include sequestrants, dye-transfer inhibitors, perfumes, bleaches, enzymes, flourescers, optical brighteners, fungicides, germicides, hydrotropes etc.

The detergent composition may be in any physical form, for example, powder, tablet, bar, paste or liquid.

The detergent active material is generally chosen from anionic, nonionic, cationic, zwitterionic detergent active compounds and mixtures thereof.

Anionic surfactants which can be used in the compositions of the invention are both soap and non-soap detergents compounds. Especially suitable anionic detergent active compounds are water soluble salts of organic sulphuric reaction products having in the molecular structure an alkyl radical containing from 8 to 22 carbon atoms, and a radical chosen from sulphonic acid or sulphur acid ester radicals and mixtures thereof.

The preferred water-soluble synthetic anionic detergent active compounds are the alkali metal (such as sodium and potassium) and alkaline earth metal (such as calcium and magnesium) salts of higher alkyl benzene sulphonates and mixtures with olefin sulphonates and higher alkyl sulphates, and the higher fatty acid monoglyceride sulphates. The most preferred anionic detergent active compounds are higher alkyl aromatic sulphonates such as higher alkyl benzene sulphonates containing from 6 to 20 carbon atoms in the alkyl group in a straight or branched chain, particular examples of which are sodium salts of higher alkyl benzene sulphonates or of higher-alkyl toluene, xylene or phenol sulphonates, alkyl naphthalene sulphonates, ammonium diamyl naphthalene sulphonate, and sodium dinonyl naphthalene sulphonate.

Suitable nonionic detergent active compounds can be broadly described as compounds produced by the condensation of alkylene oxide groups, which are hydrophilic in nature, with an organic hydrophobic compound which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

Particular examples include the condensation product of aliphatic alcohols having from 8 to 22 carbon atoms in either straight or branched chain configuration with ethylene oxide, such as a coconut oil ethylene oxide condensate having from 2 to 15 moles of ethylene oxide per mole of coconut alcohol; condensates of alkylphenols whose alkyl group contains from 6 to 12 carbon atoms with 5 to 25 moles of ethylene oxide per mole of alkylphenol; condensates of the reaction product of ethylenediamine and propylene oxide with ethylene oxide, the condensate containing from 40 to 80% of polyoxyethylene radicals by weight and having a molecular weight of from 5,000 to 11,000; tertiary amine oxides of structure $R_3NO$, where one group R is an alkyl group of 8 to 18 carbon atoms and the others are each methyl, ethyl or hydroxyethyl groups, for instance dimethyldodecylamine oxide; tertiary phosphine oxides of structure $R_3PO$, where one group R is an alkyl group of from 10 to 18 carbon atoms, and the others are each alkyl or hydroxyalkyl groups of 1 to 3 carbon atoms, for instance dimethyldodecylphosphine oxide; and dialkyl sulphoxides of structure $R_2SO$ where the group R is an alkyl group of from 10 to 18 carbon atoms and the other is methyl or ethyl, for instance methyltetradecyl sulphoxide; fatty acid alkylolamides; alkylene oxide condensates of fatty acid alkylolamides and alkyl mercaptans.

Suitable amphoteric detergent-active compounds that optionally can be employed are derivatives of aliphatic secondary and tertiary amines containing an alkyl group of 8 to 18 carbon atoms and an aliphatic radical substituted by an anionic water-solubilizing group, for instance sodium 3-dodecylamino-propionate, sodium 3-dodecylaminopropane sulphonate and sodium N-2-hydroxydodecyl-N-methyltaurate. Suitable cationic detergent-active compounds are quaternary ammonium salts having an aliphatic radical of from 8 to 18 carbon atoms, for instance cetyltrimethyl ammonium bromide.

Suitable zwitterionic detergent-active compounds that optionally can be employed are derivatives of aliphatic quaternary ammonium, sulphonium and phosphonium compounds having an aliphatic radical of from 8 to 18 carbon atoms and an aliphatic radical substituted by an anionic water-solubilising group, for instance 3-(N-N-dimethyl-N-hexadecylammonium), propane-1-sulphonate betaine, 3-(dodecylmethyl sulphonium) propane-1-sulphonate betaine and 3-(cetylmethylphosphonium) ethane sulphonate betaine.

Further examples of suitable detergent-active compounds are compounds commonly used as surface-active agents given in the well-known textbooks "Surface Active Agents", Volume I by Schwartz and Perry and "Surface Active Agents and Detergents", Volume II by Schwartz, Perry and Berch.

The detergency builders used in the formulation are preferably inorganic and suitable builders include alkali metal aluminosilicates (zeolites), alkali metal carbonate, sodium tripolyphosphate (STPP), tetrasodium pyrophosphate (TSPP), citrates, sodium nitrilotriacetate (NTA) and combinations of these. Builders may suitably be used in amounts ranging from 5 to 80 wt %, preferably from 10 to 60 wt %.

The detergent compositions of the invention may also contain any other suitable ingredients. These may be selected from, but are not limited to, bleaches, bleach precursors, bleach stabilisers (heavy metal sequestrants), photobleaches, enzymes, other polymers, foam boosters, foam controllers, fluorescers, fillers, flow aids, fabric conditioning agents, perfumes, colourants, and coloured speckles.

The polymers of the invention may also be used as part of a fabric washing kit, as part of a sachet or can be microencapsulated.

A fabric washing kit may comprise two enclosures separated from each other. It is preferred that one enclosure is big and the other small. The big enclosure contains the detergent formulation and the small enclosure the polymer. An instruction sheet contains directions for the use of the two components including the proportions and conditions under which these are to be used. The kit may also contain a dispensing means to aid the washing using the two components in the desired proportions.

A preferred kit according to the invention is a plastic container having two separate chambers. A first bigger chamber holds the detergent composition. The second small chamber has a volume capacity not greater than about 10% of the big chamber and holds the soil release polymer of the invention.

The polymer/detergent composition may also be packaged in single dose sachet having a compartment in which the two components are housed in a manner such that they come into contact when the contents are discharged from the sachet. It is also possible to microencapsulate the polymer and provide the product in a premixed form. Other forms of packagings are also included within the scope of invention.

The invention is illustrated further by the following non-limiting examples, in which parts and percentages are by weight unless otherwise stated.

EXAMPLES

Example 1

Synthesis of Soil Release Polymer 100 g urea was dissolved in 1 liter of distilled water in a flask equipped with a stirrer and a thermometer. 1 kg of tapioca starch, 1 g ferrous ammonium sulphate and 5 g ascorbic acid, 50 ml methyl acrylate were added sequentially and the mixture was stirred. 10 ml hydrogen peroxide (30% w/v) was then added, the reaction mixture stirred and then filtered. The reaction was conducted at 30° C. The starch-graft-poly (methyl acrylate) obtained was repeatedly washed with water and then dried at 100° C.

250 g of chloroacetic acid and 240 g of sodium hydroxide was dissolved in water and mixed under stirring maintaining a temperature of <20° C. 40 g urea was then added to the mixture. 1 kg of the above starch-graft-poly (methyl acrylate) was taken in a mixer and the chloroacetic acid-sodium hydroxide mixture was then sprayed on to the same under stirring. The mixture was left for 24 hours at 60° C. and then dried to 11% moisture.

Example 2

Demonstration of Soil Removal Properties of the Polymer

A standard detergent formulation without a soil release polymer was formulated (Comparative Example A). A detergent formulation incorporating the polymer of Example 1 was also prepared. The formulation details are presented in Table 1.

TABLE 1

| Composition % wt. | Comparative Example A | Example 1 |
|---|---|---|
| Linear alkyl benzene sulphonate | 20 | 20 |
| Sodium tripolyphosphate | 27 | 27 |

TABLE 1-continued

| Composition % wt. | Comparative Example A | Example 1 |
|---|---|---|
| Soda | 15 | 15 |
| Alkaline silicate | 10 | 10 |
| Fillers | 15 | 15 |
| Soil Release Polymer | — | 2 |
| Water | To 100 | To 100 |

Soil release is determined by improvement in detergency.

100% cotton and 100% polyester fabric were used in the study. The fabric was cut into swatches of dimension 5"×5". The swatches were soiled using a) oily soil and b) particulate soil (carbon soot). The oily soil could be sebum prepared in the lab or motor oil. A red dye at a concentration of 0.025% is added to the oil to clearly determine oil removal from the fabric.

Commercially available fabrics presoiled with a mixture of oily and particulate soil (WFK 30D was pre-soiled polyester and WFK 10D was pre-soiled cotton) were also used.

0.2 g of soil along with oil red dye at a concentration of 0.025% was loaded on to each of the test swatches and the stain was allowed to wick for a period of 24 hrs. Initial reflectance measurement at 520 nm was taken, on a Milton Roy Color Scan II. 520 nm is the wavelength at which the red dye absorbs, hence it is used to monitor soil removal.

For particulate soil loading, carbon soot was deposited to the cloth piece to get a reflectance of 55. The reflectance was determined at 460 nm.

The fabrics mentioned above were washed using the detergent compositions of Comparative Example A and Example 1, maintaining 10 replicates for each. Detergent solutions of concentration 5 g/l were then prepared.

Test swatches were washed in a tergotometer in the detergent solution for a period of 15 minutes. Reflectance measurements were taken at 520 nm (for oily soil) or 460 nm (for particulate soil and WFK 10D and 30D). The difference in reflectance of the soiled fabrics before and after washing was noted and represented as ΔR520* or ΔR460*.

The improvement in soil removal for oily soil was determined as follows:

$$\text{Improvement in oily soil removal } (\Delta\Delta R520^*) = \Delta R520^* \text{ (for Example 1)} - \Delta R520^* \text{ (for Comparative Example A).}$$

The improvement in soil removal for particulate and mixtures of oily and particulate was determined as follows:

$$\text{Improvement in soil removal } (\Delta\Delta R460^*) = \Delta R460^* \text{ (for Example 1)} - \Delta R460^* \text{ (for Comparative Example A)}$$

The results of the tergotometer washes following the above detergency test procedure for removal of soils from polyester are presented in Table 2. Test results for cotton are presented in Table 3.

TABLE 2

| Polyester | | |
|---|---|---|
| Particulate soil | ΔΔR460* | 2.4 |
| Artificial sebum | ΔΔR520* | 1.6 |
| Motor oil | ΔΔR520* | 2.5 |
| Mixture of oily and particulate soil | ΔΔR460* | 2.0 |

TABLE 3

| Cotton | | |
|---|---|---|
| Particulate soil | ΔΔR460* | 3.0 |
| Artificial sebum | ΔΔR520* | 0.5 |
| Motor oil | ΔΔR520* | 0.5 |
| Mixture of oily and particulate soil | ΔΔR460* | 2.0 |

The above reflectance measurements indicate benefits in use of an anionic, hydrophobic graft copolymer of starch in removal of both oily and particulate soil or their mixture on both polyester and cotton fabric.

We claim:

1. Anionic, hydrophobic polysaccharide having the general formula I:

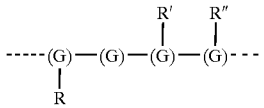

wherein R is a hydrophobic vinyl polymer G is a monosaccharide or substituted monosaccharide, R' and R", which may or may not be the same, are selected from —$R_3$—COOH and —$R_3$—$COO^-M^+$, wherein $R_3$ is a $C_1$ to $C_4$ alkylene group and M is an alkali or alkaline earth metal, and wherein the amount of the hydrophobic vinyl polymer is 0.1–10% by weight of the polysaccharide.

2. Anionic, hydrophobic polysaccharide according to claim 1, wherein R'=R"=—$CH_2$—COOH or its metal salt.

3. Anionic, hydrophobic polysaccharides according to claim 1, wherein the amount of the hydrophobic vinyl polymer is 1–5% by weight of the polysaccharide.

4. Anionic, hydrophobic polysaccharide according to claim 1, wherein the amount of R' and R" is 0.1–10% by weight of the polysaccharide.

5. Anionic, hydrophobic polysaccharide according to claim 4, wherein the amount of R' and R" is 0.1–5% by weight of the polysaccharide.

6. Anionic, hydrophobic polysaccharide according to claim 1, wherein the hydrophobic vinyl polymer has a molecular weight from 500 to 5,000,000.

7. Anionic, hydrophobic polysaccharide according to claim 6, wherein the hydrophobic vinyl polymer has a molecular weight from 2000 to 500,000.

8. Anionic, hydrophobic polysaccharide according to claim 7, wherein the hydrophobic vinyl polymer has a molecular weight from 5000 to 100,000.

9. Anionic, hydrophobic polysaccharide according to claim 1, wherein R is an acrylic polymer, having the general formula II:

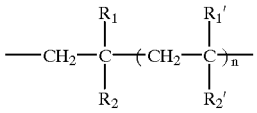

wherein $R_1$ and $R_1'$ may or may not be the same and represent —H, —$CH_3$, —$C_2H_5$ and wherein $R_2$ and $R_2'$ may or may not be the same and represent $COOCH_3$, —$COOC_2H_5$, —$COOC_3H_7$.

10. Anionic, hydrophobic polysaccharide according to claim 9, wherein $R_1$=$R_1'$=H and $R_2$=$R_2'$=—$COOCH_3$.

11. Anionic, hydrophobic polysaccharide according to claim 1, wherein the polysaccharide is selected from starch, modified starches, cellulose, guar gum, and tamarind gum.

12. Anionic, hydrophobic polysaccharide according to claim 11, wherein the polysacchande is starch.

13. A process for the preparation of an anionic, hydrophobic polysaccharide according to claim 1, comprising graft copolymerisation and anionic modification of a polysaccharide, comprising anionic modification of the polysaccharide or the graft copolymerised polysaccharide using halocarboxylic acid or its salt or mixtures thereof.

14. A process according to claim 13, comprising graft copolymerisation of the polysaccharide or the anionically modified polysaccharide using a redox initiator.

15. A process according to claim 14, comprising graft copolymerisation of the polysaccharide or the anionically modified polysaccharide using ferrous ammonium sulphate and hydrogen peroxide as the redox initiator.

16. A process according to claim 13, wherein the halocarboxylic acid is chloroacetic acid.

17. A fabric treatment composition comprising a fabric treatment agent and from 0.0 to 10 wt % of an anionic, hydrophobic polysaccharide according to claim 1.

18. A detergent composition comprising from 5 to 60 wt % of a detersive surfactant and from 0.01 to 10 wt % of an anionic, hydrophobic polysaccharide according to claim 1.

19. A detergent composition according to claim 18, which is a built laundry detergent composition comprising from 5 to 40 wt % of detersive surfactant and from 5 to 80 wt % of detergency builder.

* * * * *